United States Patent [19]

Schultz

[11] 4,194,714

[45] Mar. 25, 1980

[54] FOLDABLE PURSE HANGER AND WHISTLE

[75] Inventor: Wilderich C. Schultz, Chula Vista, Calif.

[73] Assignee: Prima International, El Cajon, Calif.

[21] Appl. No.: 834,641

[22] Filed: Sep. 19, 1977

Related U.S. Application Data

[63] Continuation-in-part of Ser. No. 666,649, Mar. 15, 1976, abandoned.

[51] Int. Cl.[2] ..... A45C 13/00

[52] U.S. Cl. ..... 248/308; 46/179; 116/137 R; 116/DIG. 1; 248/215

[58] Field of Search ..... 248/1, 200, 214, 215, 248/304, 308, 544, 615, 188.9; 116/137 R, DIG. 1; 46/179

[56] References Cited

U.S. PATENT DOCUMENTS

| | | | |
|---|---|---|---|
| 2,064,133 | 12/1936 | Von Schroeder | 248/214 |
| 2,473,086 | 6/1949 | Montero | 248/308 |
| 2,500,881 | 3/1950 | Stader | 248/304 |
| 2,532,255 | 11/1950 | Davis | 248/215 |
| 2,631,803 | 3/1953 | Meyers | 248/215 |

FOREIGN PATENT DOCUMENTS

| | | | |
|---|---|---|---|
| Ad.83572 | 7/1964 | France | 248/188.9 |

*Primary Examiner*—Roy D. Frazier
*Attorney, Agent, or Firm*—Keith D. Beecher

[57] ABSTRACT

A hanger for womens purses, handbags, shopping bags, or other articles, is provided which consists of a pair of elongated hinged support arms with a rubber semi-cylindrical bail mounted at the distal end of one of the arms, and with some means at the distal end of the other arm from which a purse, or other article may be suspended. The hanger is constructed to extend over the edge of a flat or curved surface, such as a table, chair arm, or the like, with the rubber bail engaging the surface in a non-slip relationship and with the article being suspended by the hanger over the edge of the table top, arm, or the like. The hanger is foldable to a compact configuration when not in use, and when so folded, it is constructed so that it may be used as a police whistle to summon help in cases of emergency.

4 Claims, 4 Drawing Figures

FOLDABLE PURSE HANGER AND WHISTLE

This is a continuation-in-part of copending application Ser. No. 666,649, filed Mar. 15, 1976, now abandoned.

DETAILED DESCRIPTION OF THE ILLUSTRATED EMBODIMENT

Figure 1:
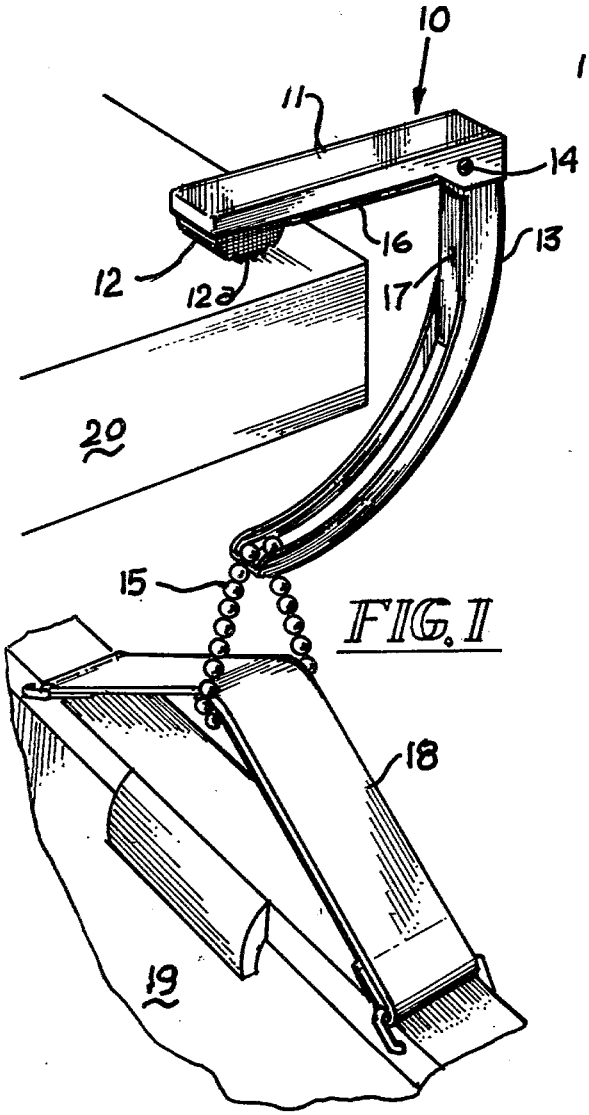
FIG. 1 is a perspective representation of the hanger of the invention, in accordance with one embodiment of the invention, showing the hanger mounted on top of a table, and showing a purse supported by the hanger over one edge of the table.
Figure 2:
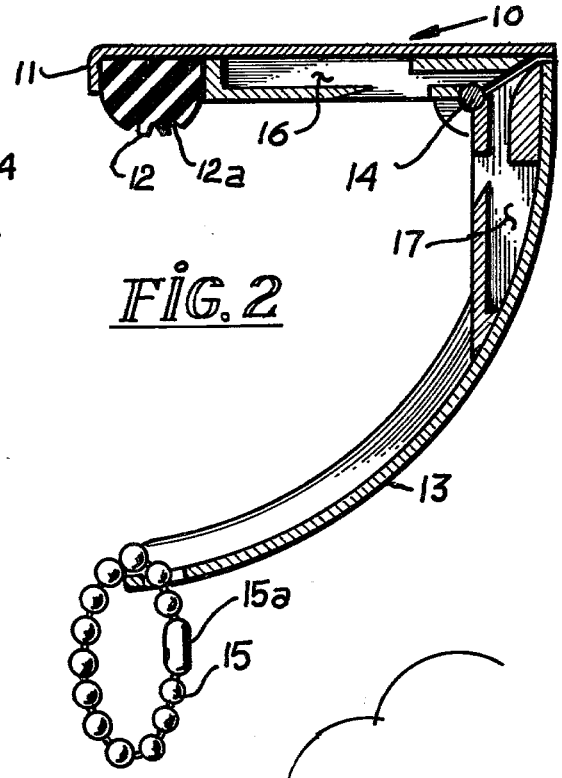
FIG. 2 is a section of the hanger assembly showing the internal components thereof which constitute a two-tone whistle when the hanger is folded into a compact configuration.
Figure 3:
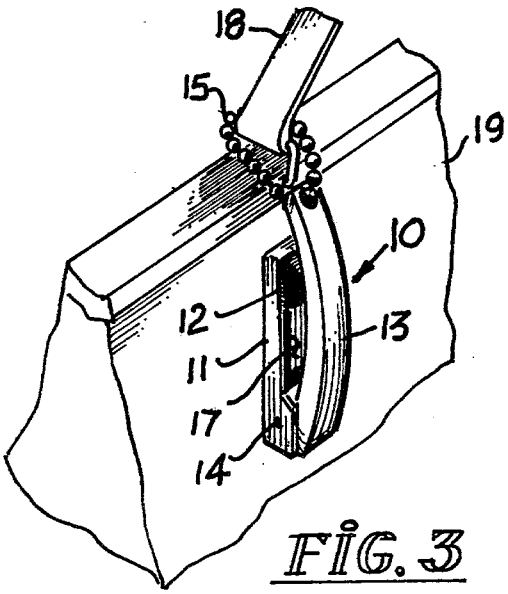
FIG. 3 is a perspective representation of the hanger in its folded configuration, and hanging from the handle of a handbag.
Figure 4:
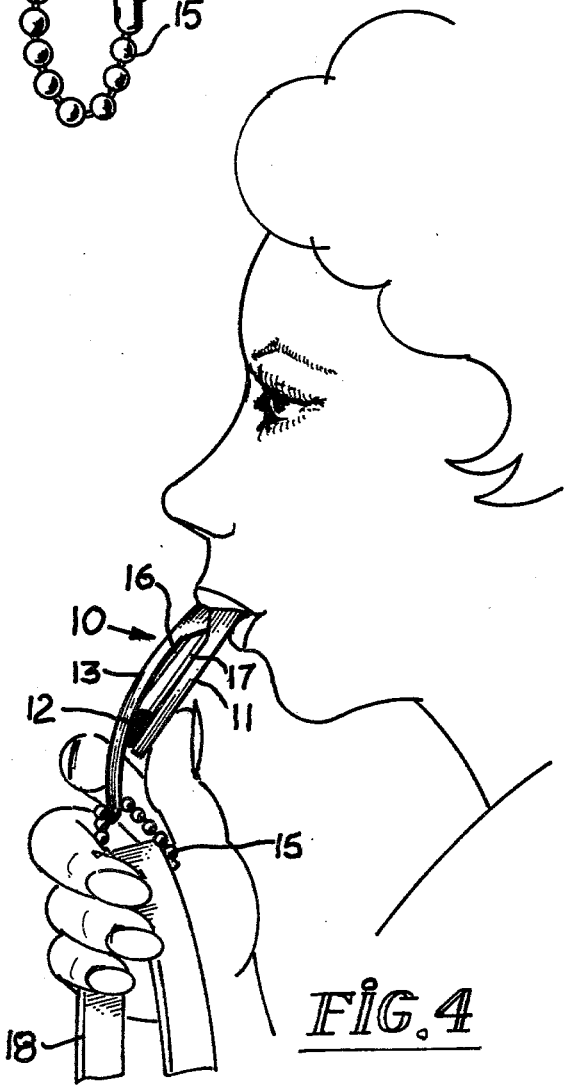
FIG. 4 shows the manner in which the hanger may be inserted into the mouth of a user to activate the whistle.

As shown in the drawing, the hanger of the invention is designated generally as 10, and it comprises a pair of channel-like elongated metallic stampings forming arms 11 and 13. The arms 11 and 13 are hinged together at their adjacent ends by means of a pin 14. The hinge permits the arms 11 and 13 to be folded together as shown in FIGS. 3 and 4, and to be opened to a position in which the arms are substantially at 90° to one another, as shown in FIGS. 1 and 2. The arm 13 is bowed, as also shown in FIGS. 1 and 2.

A semi-cylindrical rubber-like member 12 is mounted on the distal end of arm 11, and it engages the top surface of a table 20, or other supporting surface. The arcuate surface of member 12 has radially slits **12*a* formed in it, as shown in FIGS. 1 and 2**, which enhances its gripping capabilities.

A chain 15 is provided at the distal end of the arm 13, and the chain may be looped through the handle 18 of a handbag 19. The chain 15 is held together by a conventional clasp **15*a***.

As illustrated in FIG. 1, for example, the hanger may be opened to support the handbag 19 or other article from the top of the table 20. When not in use, the hanger may be folded to the position shown in FIG. 3, to be carried by the handbag. When so carried, and in the event an emergency may arise, the hanger may be inserted to the mouth, as shown in FIG. 4, and used as a police whistle.

To this end, and as shown in FIGS. 2 and 4, the internal configuration of the hanger is such as to form two separate whistles 16 and 17 of different pitches. The whistles constructed in known manner, so that when the arms 11 and 13 are folded together, and when air is blown into the junction between the arms 11 and 13, dual whistle tones are emitted, which simulate a standard police whistle.

The invention provides, therefore, a simple and inexpensive, compact hanger assembly by which a handbag, or other article, may be conveniently suspended from a table top, chair arm, or other horizontal surface; and which also can be used as a police whistle should an emergency arise.

While a particular embodiment of the invention has been shown and described, modifications may be made. It is intended in the claims to cover the modifications which come within the true spirit and scope of the invention.

What is claimed is:

1. A hanger for a purse, or the like comprising: a first elongated arm; a second elongated arm; hinge means intercoupling the first and second arms at one of the ends thereof to permit the arms to be turned from a folded position to a position in which the arms are disposed at essentially 90° to one another; first means at the distal end of the first arm for supporting the hanger on a supporting surface; second means at the distal end of the second arm for suspending a purse, or the like from the hanger; and whistle elements formed in at least one of the arms adjacent said hinge means for enabling the hanger to be used as a whistle when the first and second arms are turned to the aforesaid folded position.

2. The hanger defined in claim 1, in which the second arm is bowed.

3. The hanger defined in claim 1, in which the second means comprises a chain loop adapted to extend through the handle of the purse to attach the hanger to the purse.

4. The hanger defined in claim 1, in which said first means comprises a semi-cylindrical member formed of rubber-like material and having radial slots formed therein.

* * * * *